US008813817B2

(12) United States Patent
Waniuk et al.

(10) Patent No.: US 8,813,817 B2
(45) Date of Patent: Aug. 26, 2014

(54) COLD CHAMBER DIE CASTING OF AMORPHOUS ALLOYS USING COLD CRUCIBLE INDUCTION MELTING TECHNIQUES

(71) Applicant: Apple Inc., Cupertino, CA (US)

(72) Inventors: Theodore A. Waniuk, Lake Forest, CA (US); Joseph Stevick, Olympia, WA (US); Sean O'Keeffe, Tustin, CA (US); Dermot J. Stratton, San Francisco, CA (US); Joseph C. Poole, San Francisco, CA (US); Matthew S. Scott, San Jose, CA (US); Christopher D. Prest, San Francisco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/630,873

(22) Filed: Sep. 28, 2012

(65) Prior Publication Data

US 2014/0090793 A1 Apr. 3, 2014

(51) Int. Cl.

| | |
|---|---|
| ***B22D 17/10*** | (2006.01) |
| ***B22D 17/28*** | (2006.01) |
| ***B22D 17/30*** | (2006.01) |

(52) U.S. Cl.

USPC ..... 164/312; 164/113; 164/492; 164/493

(58) Field of Classification Search

USPC ..... 164/113, 312, 335, 336, 492, 493, 498, 164/499

See application file for complete search history.

(56) References Cited

U.S. PATENT DOCUMENTS

| | | | | |
|---|---|---|---|---|
| 3,731,727 | A | | 5/1973 | Mitamura et al. |
| 5,288,344 | A | | 2/1994 | Peker et al. |
| 5,368,659 | A | | 11/1994 | Peker et al. |
| 5,618,359 | A | | 4/1997 | Lin et al. |
| 5,711,363 | A | | 1/1998 | Scruggs et al. |
| 5,735,975 | A | | 4/1998 | Lin et al. |
| 5,860,468 | A | * | 1/1999 | Cook ..... 164/61 |
| 5,896,642 | A | | 4/1999 | Peker et al. |
| 6,021,840 | A | | 2/2000 | Colvin |
| 6,070,643 | A | * | 6/2000 | Colvin ..... 164/61 |

(Continued)

FOREIGN PATENT DOCUMENTS

| | | |
|---|---|---|
| EP | 0845316 | 6/1998 |
| EP | 1013363 | 6/2000 |

(Continued)

OTHER PUBLICATIONS

Inoue et al., "Bulk amorphous alloys with high mechanical strength and good soft magnetic properties in Fe—Tm—B(TM=IV-VIII group transition metal) system", Appl. Phys. Lett., vol. 710, p. 464 (1997).

(Continued)

*Primary Examiner* — Keith Walker
*Assistant Examiner* — Kevin E Yoon
(74) *Attorney, Agent, or Firm* — Pillsbury Winthrop Shaw Pittman LLP

(57) ABSTRACT

Various embodiments provide systems and methods for casting amorphous alloys. Exemplary casting system may include an insertable and rotatable vessel configured in a non-movable induction heating structure for melting amorphous alloys to form molten materials in the vessel. While the molten materials remain heated, the vessel may be rotated to pour the molten materials into a casting device for casting them into articles.

20 Claims, 8 Drawing Sheets

(56) References Cited

U.S. PATENT DOCUMENTS

| | | | | |
|---|---|---|---|---|
| 6,189,600 | B1 | 2/2001 | Taniguchi et al. | |
| 6,267,170 | B1 | 7/2001 | Onuki et al. | |
| 6,267,171 | B1 | 7/2001 | Onuki et al. | |
| 6,283,197 | B1 | 9/2001 | Kono | |
| 6,325,868 | B1 | 12/2001 | Kim et al. | |
| 6,371,195 | B1 | 4/2002 | Onuki et al. | |
| 6,427,753 | B1 | 8/2002 | Inoue et al. | |
| 6,875,293 | B2 | 4/2005 | Peker | |
| 7,017,645 | B2 | 3/2006 | Johnson et al. | |
| 7,488,170 | B2 | 2/2009 | Yuasa et al. | |
| 7,575,040 | B2 | 8/2009 | Johnson | |
| 7,708,844 | B2 | 5/2010 | Muramatsu et al. | |
| 7,906,219 | B2 | 3/2011 | Ohara et al. | |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0254747 | A1 | 11/2006 | Ishida et al. | |
| 2007/0079907 | A1 | 4/2007 | Johnson et al. | |
| 2007/0137827 | A1* | 6/2007 | Vogt et al. | 164/113 |
| 2008/0118387 | A1 | 5/2008 | Demetriou et al. | |
| 2008/0135136 | A1 | 6/2008 | Demetriou et al. | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis et al. | |
| 2010/0230012 | A1 | 9/2010 | Demetriou et al. | |
| 2010/0300148 | A1 | 12/2010 | Demetriou et al. | |
| 2011/0079940 | A1 | 4/2011 | Schroers et al. | |
| 2011/0108231 | A1 | 5/2011 | Zheng et al. | |

FOREIGN PATENT DOCUMENTS

| | | |
|---|---|---|
| FR | 2665654 | 2/1992 |
| JP | 6212205 | 8/1994 |
| JP | 9272929 | 10/1997 |
| JP | 2000326065 | 11/2000 |
| JP | 2001303218 | 10/2001 |
| JP | 2004050269 | 2/2004 |
| JP | 2010036210 | 2/2010 |
| WO | WO0037201 | 6/2000 |
| WO | WO2008046219 | 4/2008 |
| WO | WO2009067512 | 5/2009 |

OTHER PUBLICATIONS

Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.

McDeavitt et al., "High Temperature Interaction Behavior at Liquid Metal-Ceramic Interfaces", Journal of Materials Engineering and Performance, vol. 11, Aug. 2002.

Kargahi et al., "Analysis of failure of conducting crucible used in induction metal", Aug. 1988.

Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp, 808-813.

* cited by examiner

PRIOR ART

PRIOR ART

COLD CHAMBER DIE CASTING OF AMORPHOUS ALLOYS USING COLD CRUCIBLE INDUCTION MELTING TECHNIQUES

FIELD OF THE INVENTION

The present embodiments relate to systems and methods for casting amorphous alloys using an insertable and rotatable vessel in a non-movable induction heating structure.

BACKGROUND

Some injection molding machines use an induction coil to melt material before injecting the material into a mold. During this course, the molten material has to be retained in the melt zone without powering off the induction coil so that it does not mix too much or cool too quickly. In addition, the molten material must be poured into a port of the casting machine rapidly enough not to solidify the molten material. The conventional injection molding machines for molding an amorphous alloy are, however, designed for vertical casting.

SUMMARY

A proposed solution according to embodiments herein for casting amorphous alloys is: to use a casting system including an insertable and rotatable vessel in a non-movable induction heating structure and/or to maintain the molten materials heated when pouring them into a casting device for casting into articles.

The embodiments herein include a system for casting. The casting system may include: a casting device including an inlet port, a structure including an induction coil forming a plurality of coil helices, a vessel, etc. The structure including the plurality of coil helices may be disposed over the casting device and may be non-movable with respect to the inlet port of the casting device. The vessel may be insertable along an axial direction of the plurality of coil helices and rotatable in the plurality of coil helices in a direction perpendicular to the axial direction for pouring a material from the vessel into the inlet port of the casting device. Various embodiments also include a method of forming such casting system.

The embodiments herein also include a casting system. The casting system may include: a casting device including an inlet port, a structure including an induction coil forming a plurality of coil helices, a vessel, etc. The structure including the plurality of coil helices may be disposed over the casting device and may be non-movable with respect to the inlet port of the casting device. The vessel may be rotatable when inserted along an axial direction of the plurality of coil helices. The inlet port of the casting device may be aligned with a passage through adjacent coil helices of the induction coil. Various embodiments also include a method of forming such casting system.

The embodiments herein further include methods for casting amorphous alloys by first obtaining a casting system. The casting system may include a casting device, an induction heating structure, and a vessel. The induction heating structure may include an induction coil forming a plurality of coil helices disposed over and non-movable with respect to an inlet port of the casting device. The vessel, e.g., containing a material to be melted, may be inserted in an axial direction into the plurality of coil helices. The material in the vessel may then be heated and melted to form a molten material by supplying power to the induction coil. To pour the molten material into the inlet port of the casting device, the vessel may be rotated in the non-movable induction heating structure, while the heating is maintained without powering off the induction coil.

The embodiments herein further include methods for casting amorphous alloys by first obtaining a casting system. The casting system may include a casting device, an induction heating structure, and a vessel. The induction heating structure may include an induction coil forming a plurality of coil helices disposed over and non-movable with respect to an inlet port of the casting device. The vessel, e.g., containing a material to be melted, may be inserted in an axial direction into the plurality of coil helices. The material in the vessel may then be heated and melted to form a molten material by supplying power to the induction coil. To pour the molten material into the inlet port of the casting device, the vessel may be rotated in the non-movable induction heating structure, while the heating is maintained without powering off the induction coil. Following pouring the molten material in the inlet port of the casting device, the induction coil may be powered off and the vessel may be withdrawn from the plurality of coil helices. The vessel is then ready to receive a second material for melting and casting into articles by repeating the above-described steps.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG parts, there is a need to develop methods for casting BMG parts having controlled amount of amorphicity.

Figure 1:
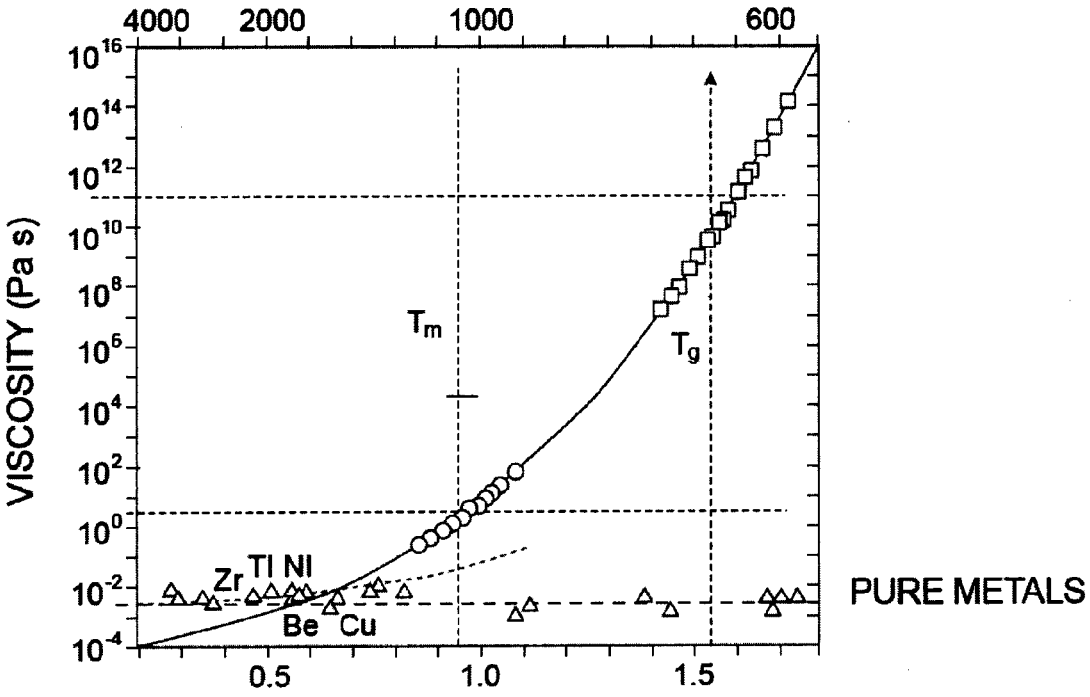
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
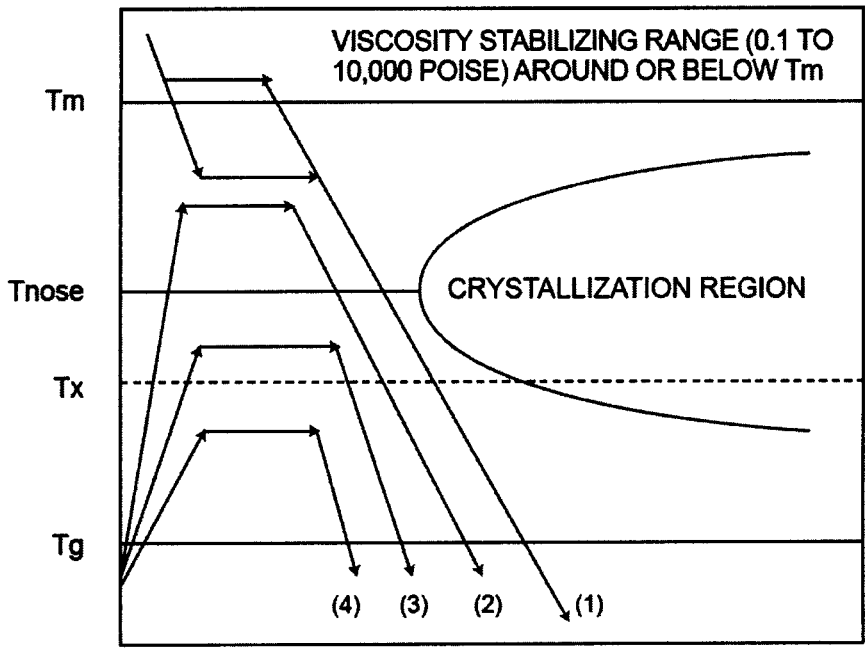
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG parts. Furthermore, the cooling rate of the molten metal to form a BMG part has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can comprise multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can comprise a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can comprise multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function: $G(x,x')=\langle s(x),s(x')\rangle$.

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses," Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically comprises a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can comprise the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_0$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |

TABLE 2-continued

Additional Exemplary amorphous alloy compositions (atomic %)

| Alloy | Atm % | Atm % | Atm % | Atm % | Atm % | Atm % |
|---|---|---|---|---|---|---|
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0118387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)—C—B, Co—Cr—Mo-Ln-C—B, Fe—Mn—Cr—Mo—(Y,Ln)—C—B, (Fe, Cr, Co)—(Mo,Mn)—(C, B)—Y, Fe—(Co,Ni)—(Zr,Nb,Ta)—(Mo,W)—B, Fe—(Al, Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions $Fe_{80}P_{12.5}C_5B_{2.5}$, $Fe_{80}P_{11}C_5B_{2.5}Si_{1.5}$, $Fe_{74.5}Mo_{5.5}P_{12.5}C_5B_{2.5}$, $Fe_{74.5}Mo_{5.5}P_{11}C_5B_{2.5}Si_{1.5}$, $Fe_{70}Mo_5Ni_5P_{12.5}C_5B_{2.5}$, $Fe_{70}Mo_5Ni_5P_{11}C_5B_{2.5}Si_{1.5}$, $Fe_{68}Mo_5Ni_5Cr_2P_{12.5}C_5B_{2.5}$, and $Fe_{68}Mo_5Ni_5Cr_2P_{11}C_5B_{2.5}Si_{1.5}$, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl, Phys. Lett., Volume 71, p 464 (1997), Shen et al., Mater. Trans., JIM, Volume 42, p 2136 (2001), and Japanese Patent Application No. 200126277 (Pub, No. 2001303218 A). One exemplary composition is $Fe_{72}Al_5Ga_2P_{11}C_6B_4$, Another example is $Fe_{72}Al_7Zn_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include $Pd_{44.48}Cu_{32.35}CO_{4.05}P_{19.11}$, $Pd_{77.5}Ag_6Si_9P_{7.5}$, and $Pt_{74.7}Cu_{1.5}Ag_{0.3}P_{18}B_4Si_{1.5}$.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Various embodiments provide systems and methods for casting amorphous alloys. An exemplary casting system can include a vessel that is insertable and rotatable in a non-movable induction heating structure to melt amorphous alloys to form molten materials. While pouring the molten materials into a casting device, the molten materials remain heated.

In embodiments, the casting system may include a casting device including an inlet port, a structure including an induction coil forming a plurality of coil helices, a vessel, etc. The structure including the plurality of coil helices may be disposed over the casting device and may be non-movable with respect to the inlet port of the casting device. The vessel may be insertable along an axial direction of the plurality of coil helices and rotatable in the plurality of coil helices in a direction perpendicular to the axial direction. By rotating the vessel, a material, e.g., a molten material, can be poured, e.g., tilt poured, from the vessel into the inlet port of the casting device. In embodiments, the inlet port of the casting device may be aligned with a passage through adjacent coil helices of the induction coil. In this case, molten materials may be poured from the vessel through the aligned passage.

In embodiments, the disclosed casting system may be used to melt and cast amorphous alloys into various BMG articles. For example, metals or alloys or feedstock of BMG parts for forming BMG articles may be placed in a vessel. The vessel may be inserted in the axial direction into the plurality of coil helices. Material in the vessel may then be heated and melted to form a molten material by supplying a power to the induction coil. To pour the molten material into the inlet port of the casting device, the vessel may be rotated in the non-movable induction heating structure, while the heating is maintained, i.e., without powering off the induction coil. Following pouring the molten material in the inlet port of the casting device, the induction coil may be powered off and the vessel may be withdrawn from the plurality of coil helices. The vessel is then ready to receive a second material for melting and casting into articles by repeating the above-described steps.

Systems and Methods

The various embodiments relate to horizontal cold crucible induction melting (CCIM) systems applied to the melting and introduction of feedstock for subsequent cold chamber die casting. In one embodiment, a water-cooled silver boat is positioned above the pour hole for a cold chamber die caster. Alloy feedstock on top is melted and then poured into the cold chamber by rotating the boat through its long axis, with the melt coil split or spaced to prevent contact with the molten alloy during the pour. Other embodiments involve the use of skull or levitation CCIM systems positioned above the pour hole which are tilt poured or bottom poured to introduce alloy into the cold chamber.

As compared to existing vertical cold crucible induction melting systems, the alloy material would be melted in a crucible located above the hole in a cold chamber into which the molten material would be poured and a plunger would then push the molten material into the mold. This method allows the use of a cold copper crucible to minimize contamination. Also, one can separate the melting process from the molding process, thereby forming clean molten material, that could possibly be filtered of any undesirable material, before pouring the molten material in the cold chamber crucible.

Referring now to the drawings wherein like reference numerals refer to similar or identical parts throughout the several views. Note that devices, systems, and methods depicted in FIGS. 3-7 are merely examples and described primary using a die-casting machine as an example, although one of ordinary skill in the art would appreciate that any kind of casting machines and casting methods can be used and incorporated in the present disclosure.

Figure 3A:
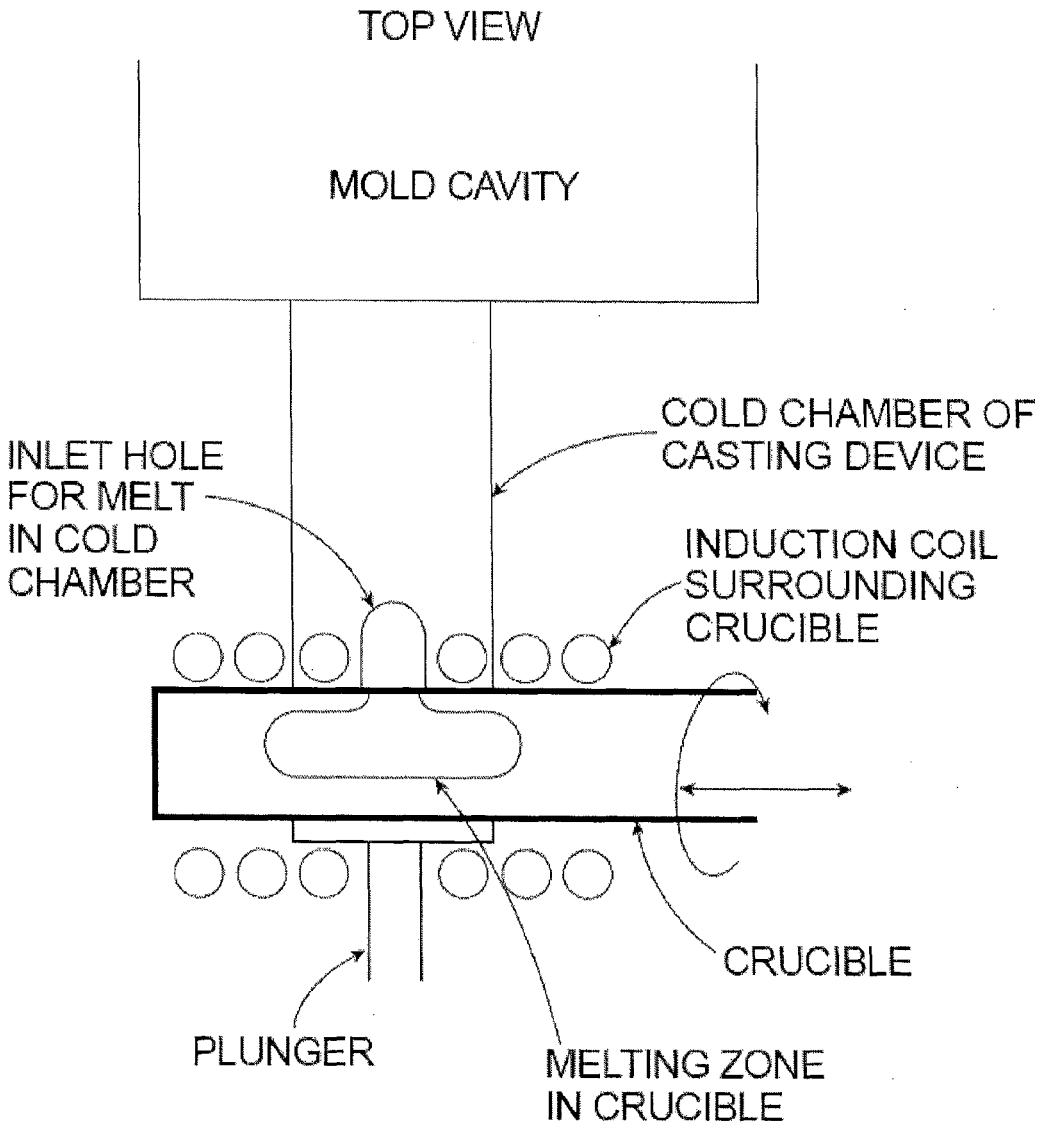
FIG. 3*a* depicts a top view of an exemplary casting system in accordance with various embodiments of the present teachings.

FIG. 3*a* shows a top view an embodiment of the horizontal cold crucible induction melting system. A casting system of FIG. 3*a* comprises a horizontal casting device, an induction coil and a vessel insertable and rotatable in a space enclosed by the induction coil. The horizontal casting machine can have a mold cavity, a cold chamber and a plunger. The cold chamber has an inlet port for receiving a molten material. The induction coil comprising a plurality of coil helices. The induction coil is located in a vicinity of the inlet port. The vessel insertable and rotatable in a space enclosed by the induction coil is configured for tilt pouring a molten material from the vessel into the inlet port of the casting device. The casting system is configured for horizontal casting of a bulk solidifying amorphous alloy.

Another embodiment relates to a casting system comprising a casting device comprising an inlet port; a structure comprising an induction coil comprising a plurality of coil helices disposed over the casting device, wherein the structure is non-movable with respect to the inlet port of the casting device; and a vessel rotatable in the plurality of coil helices when inserted along an axial direction of the plurality of coil helices, wherein the inlet port of the casting device is aligned with a passage through adjacent coil helices of the plurality of coil helices.

Optionally, the inlet port of the casting device is aligned with a passage through adjacent coil helices of the induction coil. Optionally, the vessel comprises a material substantially transparent to an induction radiation or the vessel is structured substantially transparent to an induction radiation. Optionally, the vessel is configured to melt a material when at least a portion of the vessel is inserted in the plurality of coil helices. Optionally, the vessel comprises a boat, a crucible, or a cup. Optionally, the system could further comprise a material input station connected to the vessel. Optionally, the induction coil is embedded in a material that is transparent to an induction radiation. Optionally, the system could further comprise a mechanical means to rotate and/or insert the vessel in the plurality of coil helices. Optionally, the casting device comprises a die-casting device. Optionally, the casting device is configured to have a length in a direction parallel to the axial direction of the plurality of coil helices placed there-over. Optionally, the casting device is configured to have a length in a direction perpendicular to the axial direction of the plurality of coil helices placed there-over.

Another embodiment relates to a method of forming the casting system comprising obtaining the casting device; placing the structure comprising the plurality of coil helices over the casting device; and providing the vessel insertable and rotatable in the plurality of coil helices.

Another embodiment relates to a method of forming the casting system comprising obtaining the casting device to receive a molten material to cast into articles; placing the structure comprising the plurality of coil helices over the casting device, wherein the inlet port of the casting device is aligned with the passage through adjacent coil helices of the plurality of coil helices; and providing the vessel insertable and rotatable in the plurality of coil helices.

Yet another embodiment relates to a casting method comprising obtaining a casting system comprising a casting device, an induction heating structure, and a vessel, wherein the induction heating structure comprises an induction coil comprising a plurality of coil helices disposed over and non-movable with respect to an inlet port of the casting device; inserting the vessel in an axial direction into the plurality of coil helices, wherein the vessel contains a material to be melted; heating to melt the material in the vessel to form a molten material by supplying power to the induction coil; and while heating, rotating the vessel in the non-movable induction heating structure to pour the molten material into the inlet port of the casting device.

Another embodiment relates to a casting method comprising (a) obtaining a casting system comprising a casting device, an induction heating structure, and a vessel, wherein the induction heating structure comprises an induction coil comprising a plurality of coil helices disposed over and non-movable with respect to an inlet port of the casting device; (b) inserting the vessel in an axial direction into the plurality of coil helices, wherein the vessel contains a material to be melted; (c) heating to melt the material in the vessel to form a molten material by supplying a power to the induction coil; (d) while heating, rotating the vessel in the non-movable induction heating structure to pour the molten material into the inlet port of the casting device; (e) turning off the power supplied to the induction coil; (f) withdrawing the vessel from the plurality of coil helices; and (g) receiving a second material in the vessel to repeat steps (b) through (f) to melt and cast the second material.

Optionally, this method could further comprise tilt pouring the molten material into the inlet port. Optionally, the molten material is poured without contacting the induction coil. Optionally, this method could further comprise rotating the vessel in a direction perpendicular to the axial direction of the plurality of coil helices. Optionally, this method could further comprise turning off the power supplied to the induction coil; withdrawing the vessel from the plurality of coil helices; and receiving a second material in the vessel to melt and cast the second material. Optionally, this method could comprise heating to melt the material comprises forming a skull in the vessel. Optionally, this method could further comprise transferring the material to be melted into the vessel from a material input station. Optionally, this method could further comprise casting the molten material into BMG articles in the casting device, wherein the BMG articles are formed of a Zr-based, Fe-based, Ti-based, Pt-based, Pd-based, gold-based, silver-based, copper-based, Ni-based, Al-based, Mo-based, Co-based alloy, or combinations thereof.

Optionally, the vessel comprises a skull melter. Skull melting is a containerless method for melting and crystallizing materials. The "skull" of the skull melting technique refers to what happens when materials melt while being rapidly cooled at the surface. The cooling quickly removes heat from the melt, and a thin crust (or skull) of solid is formed around the outside of the melt. In this sense, the material supplies its own container, thereby providing materials with low degrees of contamination. Skull melters are disclosed in U.S. application Ser. Nos. 13/629,936 and 13/629,947, both filed on Sep. 28, 2012 and both of which are incorporated by reference herein in their entirety. Such skull melters as disclosed in the '936 and '947 applications can be implemented in the system and/or method disclosed herein. In a skull melter type of system, e.g., in which the vessel is subdivided into fingers, it should be understood by one of ordinary skill in the art that such a vessel may not necessarily be transparent to magnetic fields, but that it does interact with them in such a way as to induce eddy currents in the items placed within. The fingers/vessel may still couple to the magnetic field, but since the vessel is water-cooled, it is substantially reduced from and/or prevented from heating up.

Figure 3B:
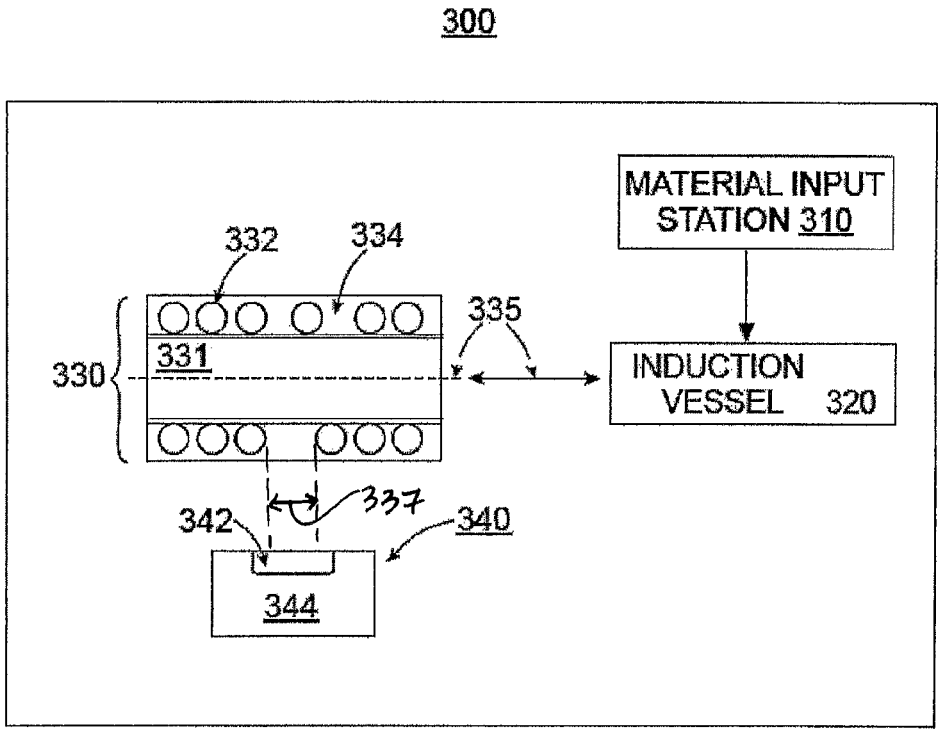
FIG. 3*b* depicts an exemplary casting system in accordance with various embodiments of the present teachings.
Figure 5:
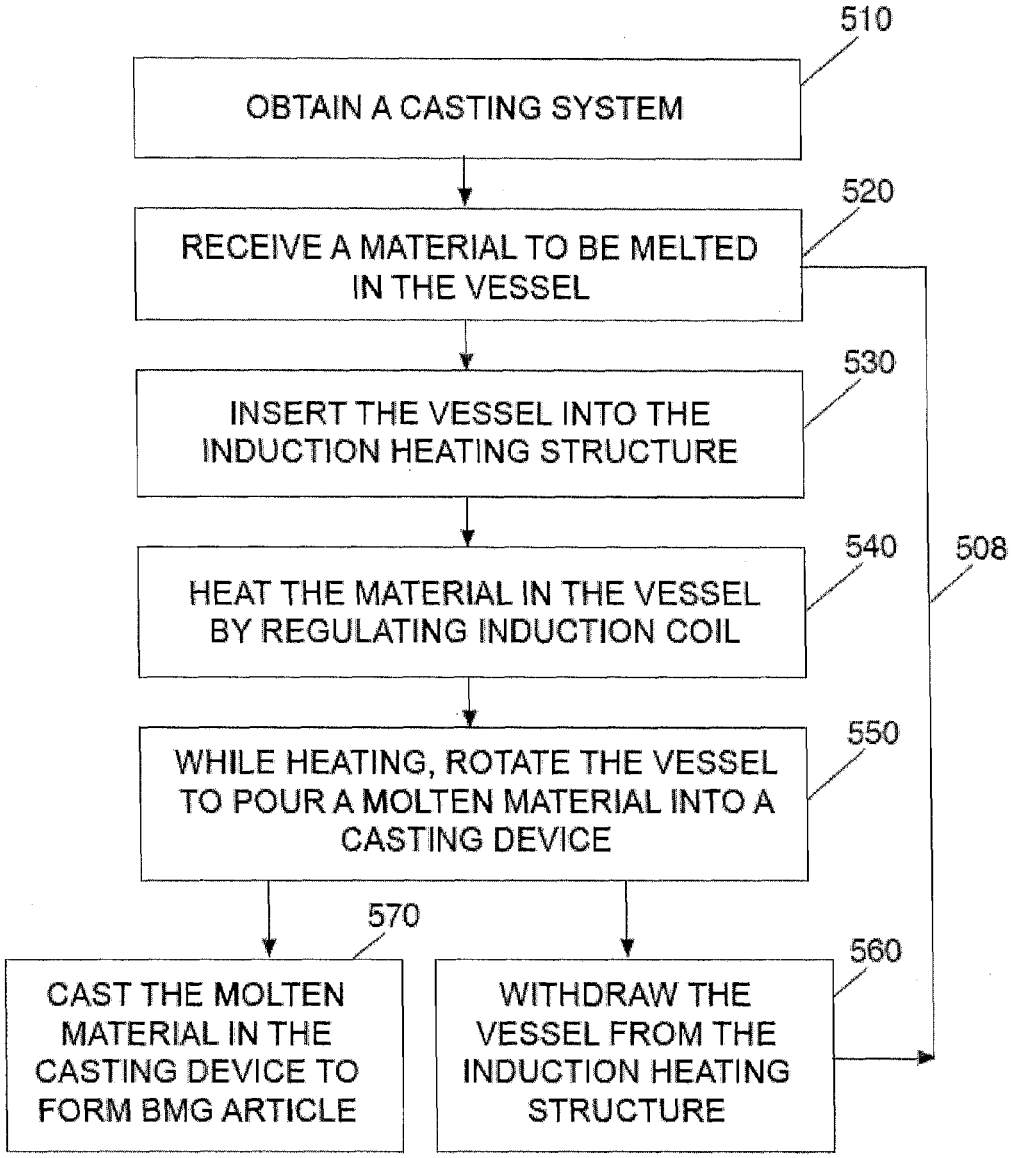
FIG. 5 depicts an exemplary casting method in accordance with various embodiments of the present teachings.
Figure 6:
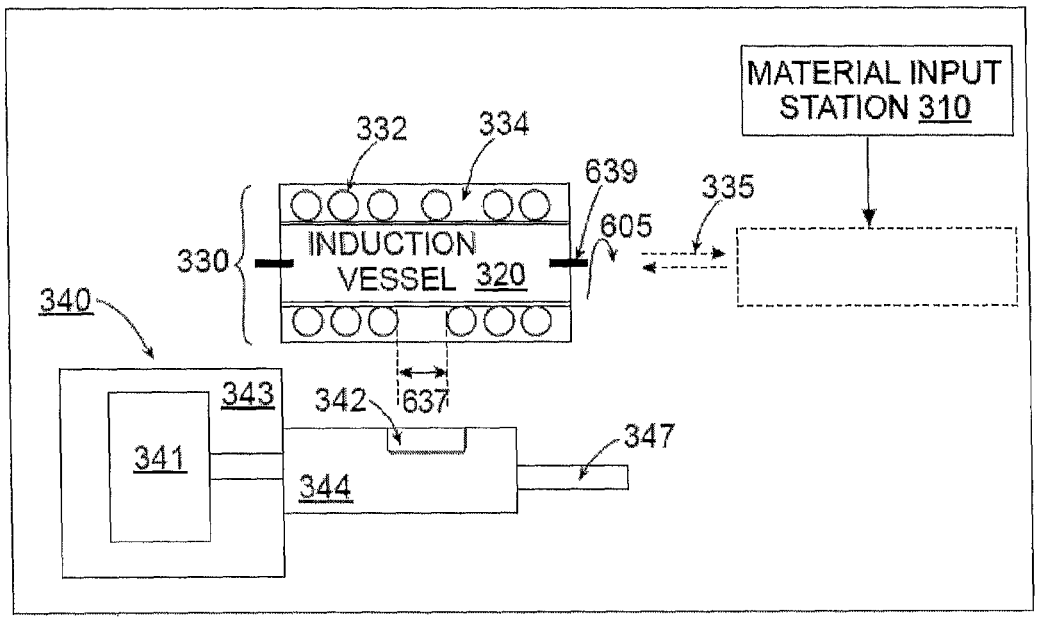
FIG. 6 depicts an exemplary system for casting in accordance with various embodiments of the present teachings.

FIG. 3*b* depicts an exemplary casting system 300 in accordance with various embodiments of the present teachings. FIGS. 5-6 depict methods and systems for casting a material into articles in accordance with various embodiments of the present teachings. Note that although the systems and methods in FIGS. 3 and 5-6 are described in related to each other, they are not limited in any manner.

The casting system 300 can include a material input station 310, a vessel 320, an induction heating structure 330, and/or a casting device 340.

The material input station 310 can be a station to store or prepare materials, such as, for example, metals, alloys, and/or BMG feedstocks, that are to be transferred to the vessel 320. The induction heating structure 330 can be disposed over the casting device 340, which has an inlet port 342 for receiving molten materials. The induction heating structure 330 can be non-movable with respect to the inlet port 342 of the casting device 340. The vessel 320 can be inserted in the induction heating structure 330 for heating and melting the materials transferred from the material input station 310 to form molten materials. While heating, the vessel 320 can rotate within the induction heating structure 330 in various directions to pour the molten materials from the vessel 320 into the inlet port 324 of the casting device 340. The transferred molten materials can then be cast into one or more final articles by using the casting device 340.

The vessel 320 may be a container in a form of, for example, a boat (e.g., see FIG. 4A), a cup, a crucible (e.g., see FIG. 4B), etc. The vessel may have any desirable geometry with any shape or size. For example, it may be cylindrical, spherical, cubic, rectangular, and/or an irregular shape.

The vessel 320 may be substantially transparent to induction radiation provided by the induction coil 332 such that an induction field can be established in the material placed inside the vessel, without the vessel itself being heated by the induction field, Materials being heated can then be melted by the induction radiation.

In embodiments, the vessel 320 may be formed of a material that is transparent to induction radiation. In other embodiments, the vessel may be formed having a structure such that the vessel is transparent to induction radiation. For example, the vessel may be formed by a metal such as copper or silver having a segmented structure, e.g., having "palisades" along a length of the vessel in a way that the induction field can be established in the materials placed inside the vessel, without the copper itself being excessively heated by the induction field. The palisades may be electrically insulated from each other.

The vessel may be formed of a ceramic, a graphite, etc. Exemplary ceramic may include at least one element selected from Groups IVA, VA, and VIA in the Periodic Table. The ceramic may include a thermal shock resistant ceramic or other ceramics. Specifically, the element can be at least one of Ti, Zr, Hf, Th, Va, Nb, Ta, Pa, Cr, Mo, W, and U. In one embodiment, the ceramic may include an oxide, nitride, oxynitride, boride, carbide, carbonitride, silicate, titanate, silicide, or combinations thereof. For example, the ceramic can include, silicon nitride, silicon oxynitride, silicon carbide, boron carbonitride, titanium boride ($TiB_2$), zirconium silicate (or "zircon"), aluminum titanate, boron nitride, alumina, zirconia, magnesia, silica, tungsten carbide, or combinations thereof. The ceramic may or may not include thermal shock sensitive ceramic, for example, yttria, aluminum oxynitride (or "sialon"), etc. The vessel may be formed of a material insensitive to radio frequency (RF) as in that used in induction heating. Alternatively, a material sensitive to RF can be used.

In embodiments, the vessel may be formed of a refractory material. A refractory material may include refractory metals, such as molybdenum, tungsten, tantalum, niobium, rehenium, etc. Alternatively, the refractory material may include a refractory ceramic. The ceramic can be any of the aforementioned ceramics, including silicon nitride, silicon carbide, boron nitride, boron carbide, aluminum nitride, alumina, zirconia, titanium diboride, zirconium silicate, aluminum silicate, aluminum titanate, tungsten carbide, silica, and/or fused silica.

In embodiments, the vessel may be formed of silicon stainless steel, silver, copper or copper-based alloys, sialon ceramic, carbide, zirconia, chrome, titanium, and stabilized ceramic coating. In one embodiment, the inner surface of the vessel for melting materials may be pre-treated. For example, a graphite vessel may be pre-treated with a coating of Zr or Si powder, or Zr- or Si-containing compounds that react with carbon. The vessel may then be heated under vacuum to force the powder to react with the vessel, forming zirconium or silicon carbide. The pre-treated vessel may be used to, e.g., melt alloy feedstock, minimizing carbon addition to alloy from the graphite.

The induction heating structure 330 of the system 300 in FIG. 3*b* may include a hollow section 331 surrounded by an induction coil 332. The induction coil 332 may be positioned in a helical pattern substantially around the hollow section 331. In embodiments, the induction coil 332 may be embedded within a material 334 to form the induction heating structure 330. In some embodiments, the material 334 may be the same or different as for the vessel 320. In other embodiments, the material 334 may not be included.

Referring to FIG. 5, at block 510, a casting system such as the system 300 can be obtained. At block 520, materials to be melted can be transferred from the material input station 310 into the vessel 320, e.g., under vacuum or an inert gas environment. In embodiments, the materials to be melted may be in various forms such as for example in a form of ingot, plate, tubing, turnings, sponge, compacts, powder and revert (recycled material from the casting process) or anything that can fit into the vessel 320. In some cases, full-certified material such as forged or rolled premium quality off-cuts may be used which has low cost and is readily available.

At block 530 of FIG. 5, the vessel 320 can then be inserted into the hollow section 331 of the induction heating structure 330 along an axial direction 335, e.g., see FIGS. 3 and 6. In embodiments, the axial direction 335 may be horizontal or vertical. As shown in FIG. 6, the inserted vessel 320 can be at least partially surrounded by the induction coil 332. The induction coil 332 may be coupled to a power source (not shown). When the induction coil 332 is powered on, an electromagnetic field is generated that heats and melts materials located within the vessel 320. The generated electromagnetic field can levitate and heat the materials in the vessel 320, e.g., see block 540 of FIG. 5. In addition, the electromagnetic field can serve, e.g., to agitate or stir the molten metal alloys in the vessel to provide uniform temperature and composition throughout the melt when the materials are heated therein.

Materials to be melted can be heated and melted in the vessel 320 in a non-reactive environment, e.g., a vacuum environment or in an inert environment such as argon, in order to prevent any reaction, contamination or other conditions which might detrimentally affect the quality of the resulting articles. In some cases, since any gasses in the melting environment may become entrapped in the molten material, the materials are melted in a vacuum environment. For example, the vessel can be coupled to a vacuum source and the heating may be carried out under a partial vacuum, such as low vacuum, or even high vacuum, to avoid reaction of the alloy with air. In one embodiment, the vacuum environment can be at about 10-2 torr or less, such as at about 10-3 torr or less, such as at about 10-4 torr or less. In embodiments, single charges or multiple charges of materials at once may be melted in the vessel.

In embodiments, a skull can form at the base of vessel. As the materials melt, they solidify against the walls of the vessel, forming a thin skin or skull on the surface. The skull insulates the molten metal from the cooling effect of the vessel 320 and minimizes the ability of molten materials to attack the vessel. The high effective power input levitates the molten metal, which further reduces heat exchange between the molten material and the skull.

The vessel 320 may further include one or more temperature regulating channels configured to regulate a temperature of the vessel such that the vessel itself will not be melted. For example, in FIGS. 4A-B, each of the exemplary vessels 420A-B may include one or more temperature regulating channels 425A-B configured to flow a fluid such as a liquid or a gas therein to regulate a temperature of the vessel 420A-B. The temperature regulating channels 425A-B, e.g., formed of copper or other thermal conductive materials, may provide passages for circulating the fluid from and to a fluid source to pull out or extract heat from the vessel, to prevent melting of the vessel. The temperature regulating channels 425A-B may be retained in position next to one another. In embodiments, the temperature regulating channels 425A-B may be embedded within the vessel walls.

Figure 7:
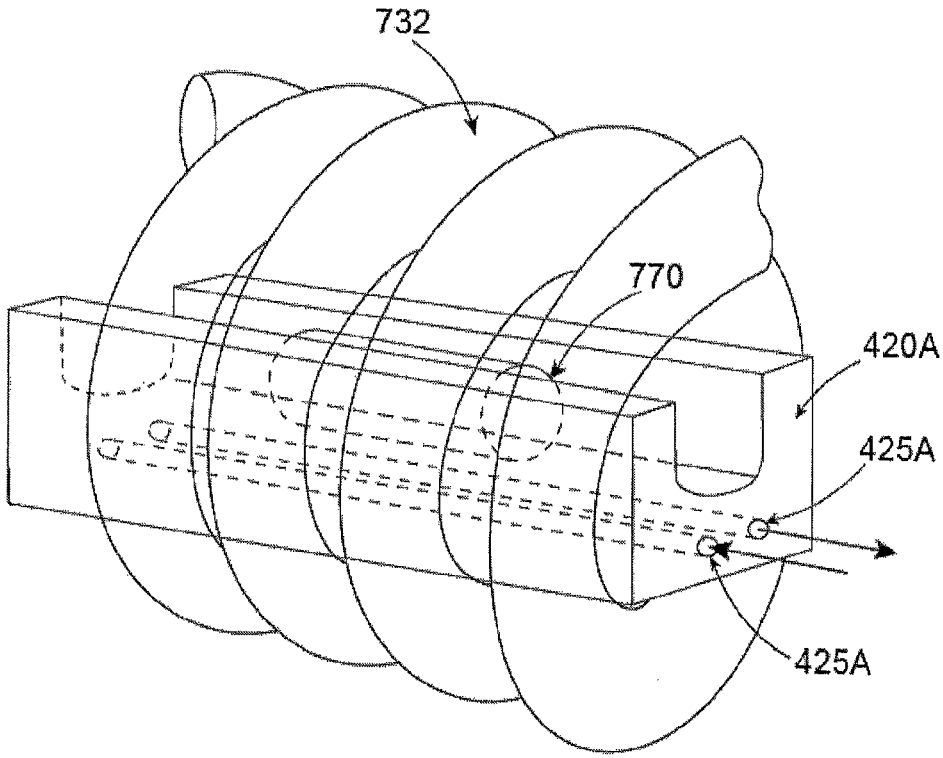
FIG. 7 depicts an exemplary melting system in accordance with various embodiments of the present teachings.

For example, FIG. 7 depicts a heating process using an exemplary induction heating structure having an induction coil 732 surrounding a hollow section. The induction coil 732 is configured to have a helical pattern. The exemplary vessel 420A is inserted into the hollow section to be at least partially surrounded by the induction coil 732. While heating the materials 770 placed in the vessel 420A, the temperature regulating channels 425A can have a fluid passing therein to regulate the temperature of the vessel 420A.

At block 550 of FIG. 5, the molten material in the vessel 320 can be poured, e.g., tilt poured, from the vessel 320 through a passage 337, e.g., a gap between adjacent helical patterns or helices of the induction coil 332, into the inlet port 342 of the casting device 340, e.g., see FIG. 6. However, as disclosed herein, when the molten material is being poured, the molten material can remain heated, i.e., the induction coil 332 is still powered on. In embodiments, the molten material can be poured into the inlet port 342 without contacting any portions of the induction coil 332.

In embodiments, the system 300/600 may further include mechanical means, e.g., 639 (shown in FIG. 6) to rotate the vessel 320 within the hollow structure 331 to pour molten materials. For example, the mechanical means e.g., 639 may include, e.g., a mechanical shaft or a handle extending from the vessel 320 for tilting the vessel such that the molten material pours into the inlet port 342. The mechanical means e.g., 639 may first tilt or rotate the vessel 320 around the axial direction 335, e.g., a horizontal swiveling axis, into a position in which the melt can be transferred from the vessel into the inlet port 342 of the casting device 340 through the passage 337 between adjacent coil helices. As shown in FIG. 6, the vessel 320 can be tilted or rotated in a direction 605 that is perpendicular to the axial direction 335.

Figure 4A:
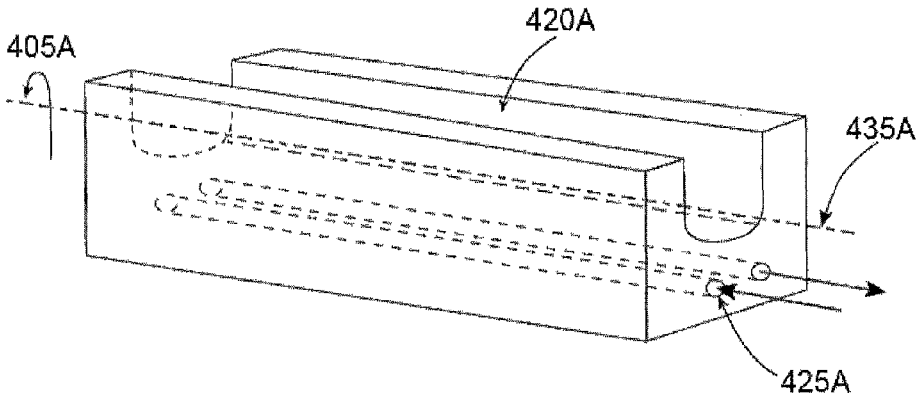
FIG. 4A depicts a perspective view of an exemplary vessel for use with a system in accordance with various embodiments of the present teachings.

In one example where the vessel is the boat 420A as shown in FIG. 4A, the boat may rotate within the hollow section 331 (e.g., see FIGS. 3 and 6) in a direction 405A perpendicular to the axial direction 335 or 435A to pour molten materials through the passage 337.

Figure 4B:
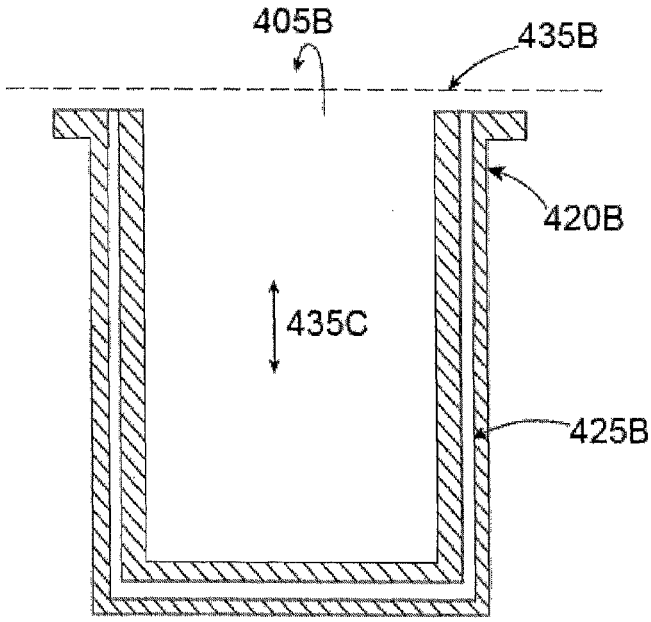
FIG. 4B depicts a sectional view of another exemplary vessel for use with a system in accordance with various embodiments of the present teachings.

In another example where the vessel is the crucible 420B as shown in FIG. 4B, the crucible may rotate within the hollow section 331 (e.g., see FIGS. 3 and 6) in a direction 405B perpendicular to the axial direction 335 or 435B to pour molten materials through the passage 337. In embodiments, the crucible 425B may be inserted in a induction structure in an axial direction 435C. In this case, the crucible 420B can rotate, within the hollow section, in a direction parallel to the direction 435C to tilt pour materials there-from.

At block 560 of FIG. 5, upon transferring or pouring the molten material into the inlet port 342, the power of the induction coil 332 can be turned off and the vessel 320 can be withdrawn from the hollow section 331 of the induction heating structure 330. The vessel 320 may then be placed in a position to receive another charge(s) of materials from the material input station 310 for another round, e.g., see block 508, of processing, which may use the same or different materials.

Meanwhile, at block 570 of FIG. 5, upon transferring or pouring the molten material into the inlet port 342, the molten material may be processed to form desired articles using the casting device 340. In embodiments, the casting device 340 may be configured in any manner with respect to the induction heating structure 330, as long as the inlet port 342 is aligned with the passage 337 of the induction heating structure 330. For example, the casting device 340 may be configured under the induction heating structure 330 having a length perpendicular to the axial direction 325 of the induction heating structure 330 as shown in FIG. 3*b*. In another embodiment, the casting device 340 may be placed under the induction heating structure 330 having a length parallel to the axial direction 325 of the induction heating structure 330 as shown in FIG. 6.

The casting device 340 may be, e.g., a die casting device, including a die 343 having a die cavity 341 and an injection device 344 for introducing the molten materials received in the inlet port 342 (e.g., of a transfer sleeve, not shown) into the die cavity 341. The die 343 may be comprised of mating die halves which are sealed together as is well known in the art of die casting. Molten materials transferred in the injection device 344 can be forced into the die cavity 341 with a ram 347 which can be, for example, hydraulic or pneumatic, or with gas pressure from gas providing means.

In the manner, BMG articles may be formed by using the disclosed casting systems and methods including use of, e.g., a die casting or other applicable casting device. The BMG articles may have various three dimensional (3D) structures as desired, including, but not limited to, flaps, teeth, deployable teeth, deployable spikes, flexible spikes, shaped teeth, flexible teeth, anchors, fins, insertable or expandable fins, anchors, screws, ridges, serrations, plates, rods, ingots, discs, balls and/or other similar structures.

Metal alloys used for forming BMG articles may be Zr-based, Fe-based, Ti-based, Pt-based, Pd-based, gold-based, silver-based, copper-based, Ni-based, Al-based, Mo-based, Co-based alloys, and the like, and combinations thereof. Metal alloys used for forming BMG articles may include those listed in Table 1 and Table 2.

For example, Zr-based alloys may include any alloys (e.g., BMG alloys or bulk-solidifying amorphous alloys) that contain Zr. In addition to containing Zr, the Zr-based alloys may further include one or more elements selected from, Hf, Ti, Cu, Ni, Pt, Pd, Fe, Mg, Au, La, Ag, Al, Mo, Nb, Be, or any combinations of these elements, e.g., in its chemical formula or chemical composition. The elements can be present at different weight or volume percentages. In embodiments, the Zr-based alloys may be free of any of the aforementioned elements to suit a particular purpose. For example, in some embodiments, the Zr-based metal alloys, or the composition including the Zr-based metal alloys, may be substantially free of nickel, aluminum, titanium, beryllium, and/or combinations thereof. In one embodiment, the Zr-based metal alloy, or the composition including the Zr-based metal alloy may be completely free of nickel, aluminum, titanium, beryllium, and/or combinations thereof.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A system comprising:

a casting device comprising an inlet port, wherein the casting device is configured to perform horizontal casting of a bulk solidifying amorphous alloy;

an induction coil comprising a plurality of coil helices for melting the bulk solidifying amorphous alloy, wherein the induction coil is located in a vicinity of the inlet port; and a vessel insertable and/or rotatable in a space enclosed by the plurality of coil helices of the induction coil, wherein the vessel is configured for tilt pouring the molten bulk solidifying amorphous alloy from the vessel into the inlet port of the casting device, wherein the induction coil is non-movable with respect to the inlet port.

2. The system of claim 1, wherein the inlet port of the casting device is aligned with a passage through adjacent coil helices of the induction coil.

3. The system of claim 1, wherein the vessel comprises a material substantially transparent to an induction radiation.

4. The system of claim 1, wherein the vessel is rotatable in the space when inserted along an axial direction of the induction coil, and wherein the inlet port is aligned with a passage through adjacent coil helices of the plurality of coil helices.

5. The system of claim 1, wherein the vessel is at least partially inserted in the space, and wherein the vessel is configured to melt the bulk solidifying amorphous alloy when at least a portion of the vessel is inserted in the plurality of coil helices.

6. The system of claim 1, wherein the vessel comprises a boat, a crucible, or a cup.

7. The system of claim 1, wherein the vessel comprises a skull melter.

8. The system of claim 1, further comprising a material input station connected to the vessel, wherein the material input station stores and/or prepares the bulk solidifying amorphous alloy for transfer into the vessel.

9. The system of claim 1, wherein the induction coil is embedded in a material that is transparent to an induction radiation.

10. The system of claim 1, further comprising a mechanical shaft or handle to rotate and/or insert the vessel in the plurality of coil helices.

11. The system of claim 1, wherein the casting device comprises a die-casting device.

12. The system of claim 1, wherein the casting device is configured to have a length in a direction parallel to an axial direction of the plurality of coil helices placed there-over or wherein the casting device is configured to have a length in a direction perpendicular to the axial direction of the plurality of coil helices placed there-over.

13. A system comprising:

a vessel configured to receive a meltable material for melting therein;

an induction heating structure configured to melt the meltable material in the vessel via application of an induction field;

a cold chamber casting device having an inlet port;

a plunger rod; and a mold for molding the molten material after application of the induction field, wherein the induction heating structure is non-movable with respect to the inlet port, wherein the vessel is positioned adjacent to the induction heating structure during application of the induction field, wherein the vessel is configured to tilt about an axis relative to the induction heating structure, wherein the vessel is further aligned with the inlet port of the cold chamber casting device for receipt of molten material upon tilting of the vessel, and wherein the plunger rod is configured to move the molten material from the cold chamber into the mold.

14. The system according to claim 13, wherein the vessel further comprises one or more temperature regulating channels, wherein the one or more temperature regulating channels are configured to regulate a temperature of the vessel during the application of the induction field by circulating a fluid therein.

15. The system according to claim 13, wherein the vessel and induction heating structure are positioned along a horizontal axis, and wherein the vessel and induction heating structure are disposed over the cold chamber.

16. The system according to claim 13, wherein the apparatus is configured to mold the material into a BMG part.

17. A system comprising:

a vessel configured to receive a material for melting therein;

an induction coil for melting the material in the vessel; and a casting device with an inlet port;

wherein the vessel comprises temperature regulating channels configured to flow the fluid therein for regulating a temperature of the vessel during melting of the material;

wherein the induction coil is non-movable with respect to the inlet port and has a hollow section for receiving the vessel;

wherein the vessel is moveable relative to the hollow section of the induction coil and configured to move molten material from the vessel and into the inlet port of the casting device; and wherein the casting device is provided under the induction coil.

18. The system according to claim 17, wherein the vessel is configured to move in a substantially horizontal direction relative to the hollow section of the induction coil.

19. The system according to claim 18, wherein the vessel is further configured to rotate relative to the induction coil to move the molten material into the inlet port.

20. The system according to claim 17, wherein the induction coil has passage through which molten material is moved, wherein the passage comprises a gap between adjacent turns of the induction coil, and wherein the inlet port of the casting device is aligned with the passage.

* * * * *